US006446982B1

(12) United States Patent
Gaster et al.

(10) Patent No.: US 6,446,982 B1
(45) Date of Patent: Sep. 10, 2002

(54) IN-LINE SKATE CONVERSION APPARATUS

(75) Inventors: Richard S. Gaster, 13460 Firth Dr., Beverly Hills, CA (US) 90210; Fred H. Stengel, Redwood City, CA (US); Thomas J. Sherlock, Los Altos, CA (US)

(73) Assignee: Richard S. Gaster, Beverly Hills, CA (US)

( * ) Notice: Subject to any disclaimer, the term of this patent is extended or adjusted under 35 U.S.C. 154(b) by 0 days.

(21) Appl. No.: 09/556,263

(22) Filed: Apr. 24, 2000

Related U.S. Application Data

(63) Continuation-in-part of application No. 09/106,979, filed on Jun. 29, 1998, which is a continuation-in-part of application No. 08/480,011, filed on Jun. 7, 1995, now Pat. No. 5,772,220.

(51) Int. Cl.[7] ..... A63C 17/14

(52) U.S. Cl. ..... 280/11.205; 280/11.211; 280/825; 188/5; 188/29; 188/68

(58) Field of Search ..... 280/11.205, 11.212, 280/11.211, 11.2, 825; 188/5, 29, 68

(56) References Cited

U.S. PATENT DOCUMENTS

| | | | | |
|---|---|---|---|---|
| 199,664 A | | 1/1878 | Robinson | |
| 988,533 A | | 4/1911 | Zverina | |
| 2,035,897 A | | 3/1936 | Kosanovich | |
| 2,148,687 A | | 2/1939 | English | |
| 2,581,809 A | | 1/1952 | Murray | |
| 3,351,353 A | | 11/1967 | Weitzner | |
| 3,387,852 A | | 6/1968 | De Sarro | |
| 3,979,842 A | | 9/1976 | Texidor | |
| 4,114,295 A | | 9/1978 | Schaefer | |
| 4,273,345 A | | 6/1981 | Ben-Dor | |
| 4,333,249 A | | 6/1982 | Schaefer | |
| 4,526,389 A | | 7/1985 | Chase | |
| 4,869,351 A | | 9/1989 | Romano | |
| 4,988,122 A | | 1/1991 | Saunders | |
| 5,171,032 A | * | 12/1992 | Dettmer | 280/11.211 |

(List continued on next page.)

FOREIGN PATENT DOCUMENTS

| | | | | |
|---|---|---|---|---|
| EP | 0003038 | * | 5/1909 | 280/11.211 |
| EP | 0 063 104 | | 10/1982 | |
| EP | 0 183 055 | | 6/1986 | |
| GB | 2 160 780 A | | 1/1986 | |
| SE | 0195109 | * | 3/1965 | 280/11.211 |

*Primary Examiner*—Paul N. Dickson
*Assistant Examiner*—Toan C To
(74) *Attorney, Agent, or Firm*—Henricks, Slavin & Holmes LLP

(57) ABSTRACT

At least one walking member is detachably connectable to an in-line skate to enable the wearer of the in-line skate to connect the walking member to the in-line skate, thus enabling the wearer to walk while wearing the in-line skate. Two walking members can be provided on alternative sides of the in-line skate wheels to provide a more stable platform for the wearer of the in-line skate. Since the two walking members are removable, the walking members do not detract from the aerodynamic and functional performance of the in-line skate, and can be manufactured together with the skate or, alternatively, can be added to the skate after purchase.

22 Claims, 12 Drawing Sheets

U.S. PATENT DOCUMENTS 5,183,292 A 2/1993 Ragin III
5,224,718 A 7/1993 Gertler
5,232,231 A 8/1993 Carlsmith
5,239,941 A 8/1993 Chibi
5,293,965 A 3/1994 Nagano
5,303,955 A 4/1994 Zurnamer
5,320,367 A 6/1994 Landis
5,340,131 A 8/1994 Smathers
5,388,844 A 2/1995 Pellegrini Jr.
5,398,970 A 3/1995 Tucky
5,400,484 A 3/1995 Gay
5,439,238 A * 8/1995 Neal ..... 280/11.211
5,445,415 A 8/1995 Campbell
5,464,235 A 11/1995 Goldman
5,503,433 A 4/1996 Lachapelle
5,505,469 A 4/1996 Zorzi
5,522,621 A 6/1996 Schneider
5,527,049 A * 6/1996 Ortiz ..... 188/5 X
5,551,711 A 9/1996 Mangelsdorf
5,573,275 A 11/1996 Smith
5,580,094 A 12/1996 Ruehlman
5,586,777 A 12/1996 Wolf
5,657,999 A * 8/1997 Beaulieu ..... 280/11.211
5,664,794 A 9/1997 Mitchell
5,697,643 A 12/1997 Marasco
5,727,796 A 3/1998 Zhang
5,765,841 A 6/1998 Johnson
5,765,870 A 6/1998 Riley
5,772,220 A 6/1998 Gaster
5,779,245 A 7/1998 Smith
5,785,327 A 7/1998 Gallant
5,791,662 A 8/1998 Searby
5,797,609 A 8/1998 Fichepain
5,803,469 A 9/1998 Yoham
5,820,138 A 10/1998 Hajat Dost Sani
5,829,756 A * 11/1998 Mitchell et al. ..... 188/29
5,833,270 A 11/1998 Hubshman
5,848,808 A 12/1998 Fenton
5,855,381 A 1/1999 Kirk
5,882,018 A 3/1999 Petrosino
5,887,989 A 3/1999 Petrosino
5,890,722 A 4/1999 Smith
5,906,380 A 5/1999 Searby
5,934,693 A 8/1999 Nicoletti
5,951,049 A 9/1999 Calverley
5,961,130 A * 10/1999 Gorza et al. ..... 280/11.211
6,042,125 A 3/2000 Wu
6,047,973 A * 4/2000 Amore et al. ..... 188/5
6,079,747 A 6/2000 Winsor
6,217,037 B1 4/2001 Gaster
6,279,922 B1 8/2001 Gaster

* cited by examiner

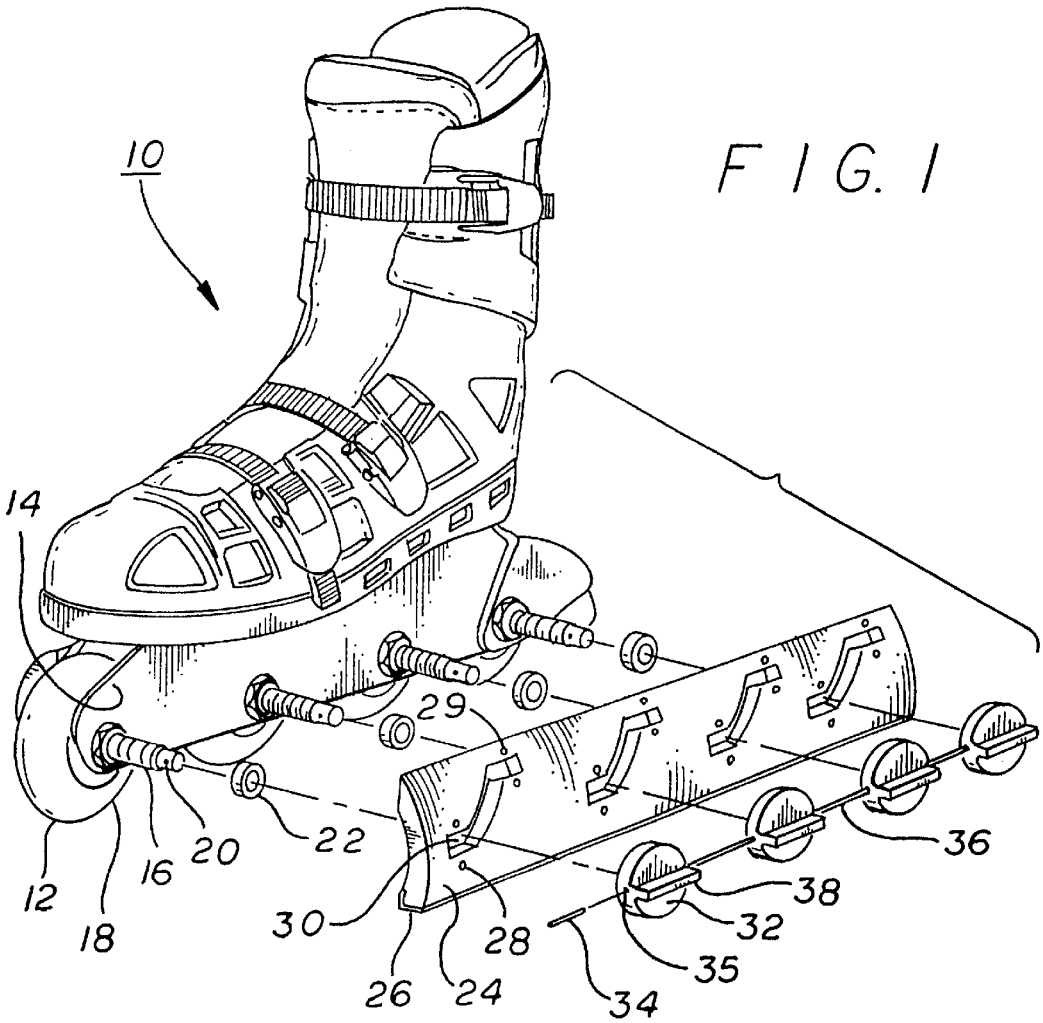
FIG. 1
FIG. 2
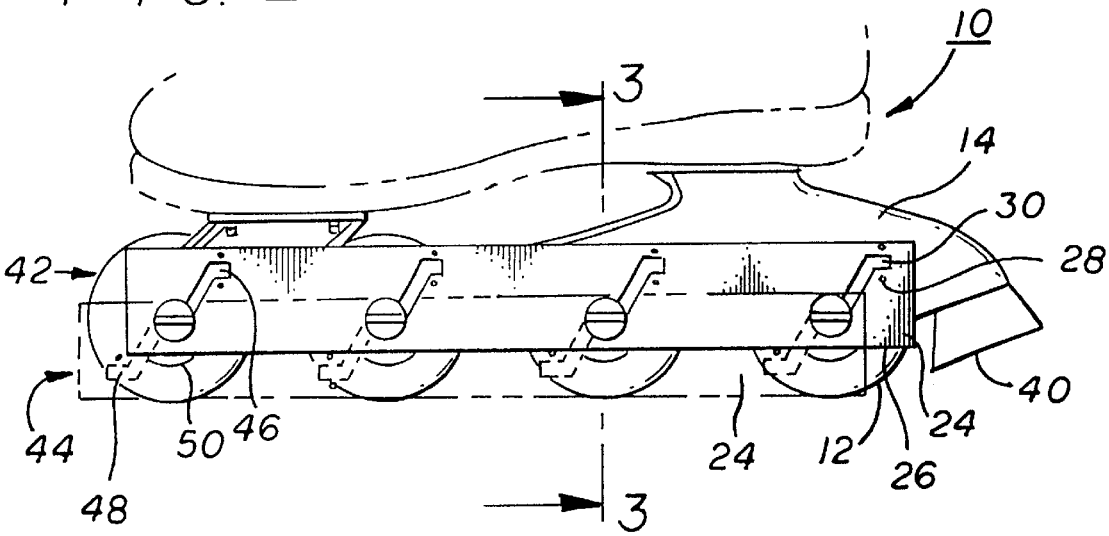

IN-LINE SKATE CONVERSION APPARATUS

CROSS-REFERENCE TO RELATED APPLICATIONS

This application is a continuation-in-part of U.S. application Ser. No. 09/106,979, filed Jun. 29, 1998, which is itself a continuation-in-part of U.S. application Ser. No. 08/480,011, filed Jun. 7, 1995, now U.S. Pat. No. 5,772,220. Each of these applications are incorporated herein by reference.

BACKGROUND OF THE INVENTION

1. Field of Invention

The present invention is directed to in-line skates. More particularly, the present invention is directed to apparatus that enable the wearer of the in-line skate to walk in the skate without fear of falling.

2. Description of the Related Art

In-line skating has exploded in popularity over the last several years. Indeed, in-line skates have replaced roller skates in popularity. One of the reasons for the surge in popularity of in-line skating may be due to the wide variety of equipment available and the lack of a requirement that in-line skating be performed in any particular place. That is, unlike ice skating which requires an individual to go to an ice rink, or roller skating which has traditionally be enjoyed in roller skating rinks, in-line skates are specifically manufactured for use in the outdoors, provided there is a suitable hard surface to skate on. Furthermore, due to the relatively low cost of beginning participation in the sport—which typically requires the purchase of the skates and optional padding for elbows, knees and wrists—in-line skating is economically feasible for most people. As in-line skating has developed, several problems have arisen.

In particular, novice in-line skaters often time have difficulty braking or otherwise slowing themselves down after building up speed. One of the difficulties with braking in in-line skates is the requirements that pressure be placed on a brake pad located substantially rearward of the heel of the wearer. Many skaters have complained that the application of pressure in a downward fashion at the heel by raising the toe is an unnatural motion which requires coordination. Skaters often time lose balance and fall when attempting to brake in this fashion. To solve the problem with braking in in-line skates, numerous individuals have attempted to offer different braking solutions. For example, U.S. Pat. No. 5,320,367 to Landis which issued on Jun. 14, 1994, disclosed a braking apparatus which utilizes a hand-held brake control for causing the application of rubber brake pads to the wheels of the in-line skate to slow the wearer down. In addition, major in-line skate manufacturers such as Rollerblade have proposed alternative braking mechanisms to assist the wearer in the braking operation.

After the wearer has stopped, however, the wearer must still be able to maneuver on the in-line skates. This has lead to another problem in that once an in-line skater has stopped, in order to move in any direction, the wearer of the skates must roll to the next location. This can often make it quite awkward for a novice in-line skater to, for example, stop at an outdoor snack bar to have lunch. After ordering the food from the window, the skater must carry the food from the window to, for example, a nearby table. The act of carrying the food from the window to the nearby table can represent a terrifying journey for a novice in-line skater. Indeed, the inventor of the instant application had food splattered on him because his mother was unable to stop on her in-line skates while she was carrying food from an outdoor snack bar to the table.

In addition to the above-described '367 patent, U.S. Pat. No. 4,273,345 to Ben-Dor et al. provides a friction plate for the wearer of the skate to drag along the ground to stop the movement of the skate. U.S. Pat. No. 3,351,353 to D. M. Weitzner discloses a pair of retractable roller and ice skates for shoes. As seen in FIGS. 10 and 13 of the '353 patent, the shoe can be taken apart so that a plate 50 is removed from its channel, inverted, and then reinserted into the channel 40 above the roller assemblies. The plate is thus stored out of the way in the channel and at the same time serves as a spacer and bearing member holding the roller assembly 70 in a stable position in the sole of the shoe, thus enabling the shoe to serve as a roller skate. While the device enables a shoe to be worn as a roller skate, it requires the shoe to be disassembled and reassembled prior to wearing the roller portion of the shoe.

Similarly, U.S. Pat. No. 3,979,842 to Texidor discloses an athletic shoe exerciser which retains rollers when they are not being used in a lower portion of the exerciser. Specifically, as seen in FIG. 2, the roller skates are folded up into the base 14 of the shoe when not in use. Other modifications are sports shoes are also known. For example, U.S. Pat. No. 4,114,295 to Schaefer discloses a convertible sports shoe which may be converted from a roller skate to an ice skate. Similarly, U.S. Pat. No. 3,387,852 discloses roller skates which can be removed from the bottom of the shoe 20. U.S. Pat. No. 5,224,718 to Gertler discloses a foot transport device which can be fastened to a standard walking shoe. Finally, U.S. Pat. No. 4,988,122 discloses a combination roller skate and ice skate which includes a boot which can have a roller portion or an ice skate portion attached thereto.

SUMMARY OF THE INVENTION

The inventor has determined that a need exists for a conversion apparatus which would enable the wearer of standard in-line skates to walk on the skates without activating the wheels thereof. As such, one object of the present invention is to provide such an apparatus. Another object of the present invention is to provide an economically efficient apparatus for converting a standard in-line skate to a walking shoe without sacrificing the performance characteristics of the in-line skate.

In order to accomplish some of these and other objectives, an apparatus in accordance with one embodiment of the present invention includes at least one walking member which extends from a wheel support plate in a downward direction to a position equal to or beyond the range of the wheels. When the walking member is extended, the in-line skate is converted to a relatively stable walking platform to enable the wearer to maneuver in relative safety.

In order to accomplish some of these and other objectives, an apparatus in accordance with another embodiment of the present invention includes a pair of detachable walking members which allow the wearer to selectively decouple the walking members and entirely remove them from the in-line skate, only engaging the walking members with the skate when they are needed to walk. Thus, those users of in-line skates who do not prefer to have a walking member permanently coupled with the skate may utilize the detachable walking members. For convenience, the pair of detachable walking members may be connected via a flexible member.

In order to accomplish some of these and other objectives, an apparatus in accordance with still another embodiment of the present invention includes a wheel engagement member and a support device adapted to support the wheel engagement member on the in-line skate such that the wheel engagement member is movable between a first position wherein the wheel engagement member engages at least one of the wheels and a second position wherein the wheel engagement member is disengaged from the at least one wheel.

The present invention provides a number of important advantages. For example, the walking members and wheel engagement members enable the wearer to walk from an outdoor snack counter without having to worry about the ability to stop once she arrived at the table. In this fashion, she could avoid spilling food and drinks on her children by maintaining control at all times. They also enable the wearer of in-line skates to skate from, for example, from their home to a place of business such as a store, and then convert the skate to a walking shoe to allow the individual to enter the premises. After the user has conducted their business in the premises, he can leave the business, reconvert the skates to standard in-line skates, and then continue on his way using the in-line skates in the normal fashion.

The present invention also provides for the conversion of in-line skates to walking shoes while maintaining the aerodynamic and performance qualities of the in-line skates such that the device will be acceptable to both advanced as well as novice in-line skaters. Furthermore, the present invention may be adapted to presently existing in-line skates through the use of simple conversion hardware. It is economical to install and cost effective to manufacture.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 1 is an exploded perspective view of an in-line skate incorporating one embodiment of the present invention.

FIG. 2 is a partial side view of the in-line skate illustrated in FIG. 1.

DETAILED DESCRIPTION OF THE PREFERRED EMBODIMENTS

Figure 3:
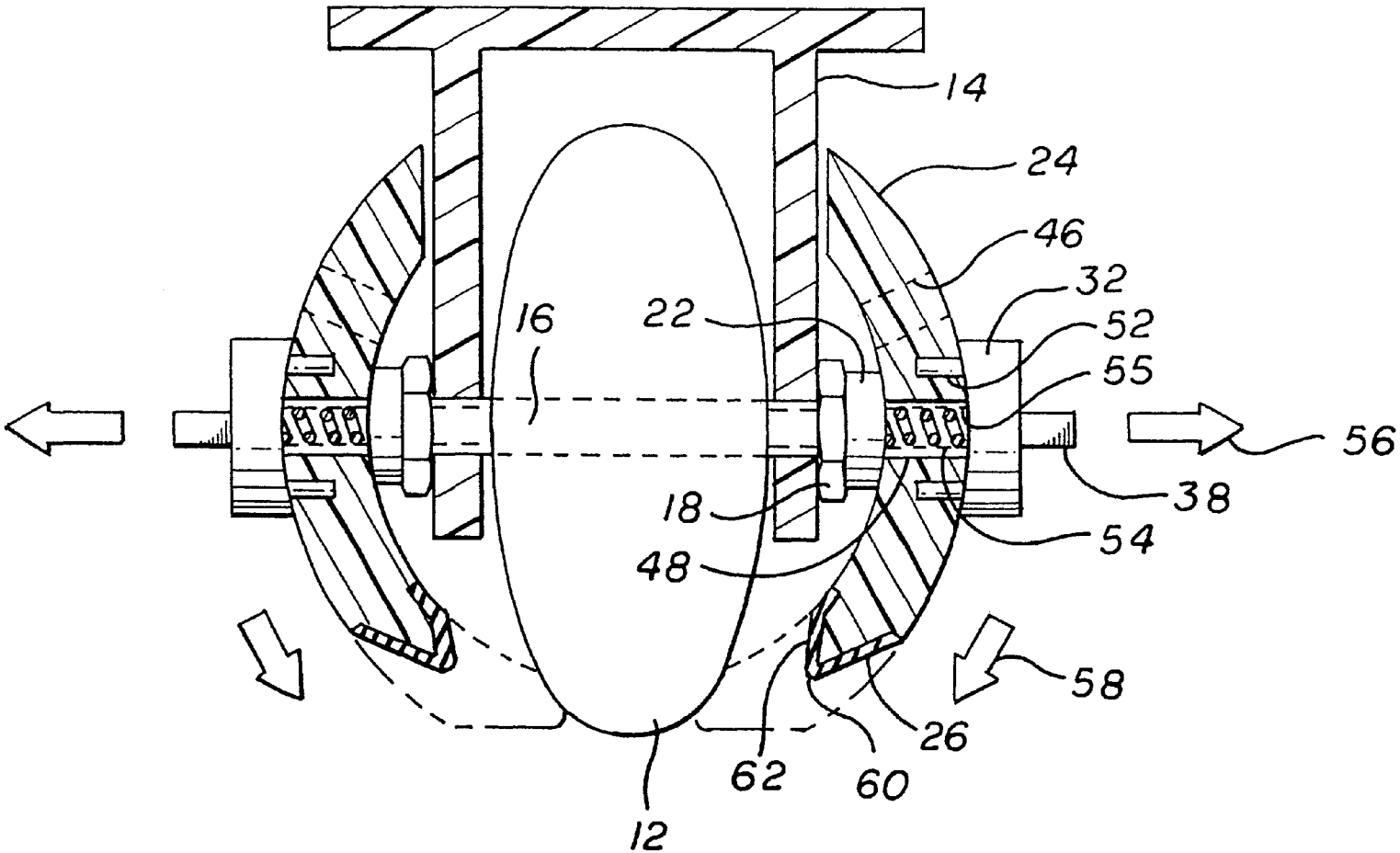
FIG. 3 is a partial section view taken along lines 3–3inf FIG. 2.

The following is a detailed description of the best presently known modes of carrying out the invention. In the following discussion of the presently preferred embodiments, like reference numerals refer to like elements. Further, the following discussion is not to be considered in a limiting sense. Rather, while the following discussion taken in conjunction with the drawings illustrate the presently preferred embodiments of the present invention, the invention is in no way limited to the embodiments described below and shown in the drawings. It is to be understood that numerous modifications, additions and/or substitutions can be made to the preferred embodiments without departing from the spirit and scope of the invention.

FIGS. 1–3 illustrate a first preferred embodiment of the present invention.

An in-line skating boot 10 in accordance with the illustrated embodiment incorporates a plurality of wheels 12 which are connected to the boot 10 through a pair of wheel support members or plates 14. A plurality of bolts 16 connect the wheels support plates 14, which are connected to the underside of the boot 10, to the wheels 12. A plurality of nuts 18 are used to fasten the bolts 16 in place on the wheel support plates 14. The bolts 16 are threaded at appropriate locations to allow the nuts 18 to be secured thereto. Further, one skilled in the art will recognize that washers may be placed between the nuts 18 and the wheel support plates 14. Likewise, washers may also be used between the wheel support plates 14 and the wheels 12. At this point, it should be understood that while the following description and references to the drawings will be made primarily to a single side of the in-line skating boot 10 incorporating the present invention (e.g., as seen in FIG. 1), the present invention can incorporate similar elements on each side of the wheels 12 as seen in, for example, FIG. 3.

The bolts 16 illustrated in FIG. 1 incorporate a tubular receptacle 20 at locations substantially adjacent to respective ends thereof. Referring more specifically to FIG. 1 and 3, it is seen that a spacer 22 is fitted over the bolt 16 and rests substantially adjacent to the nut 18. The spacers 22 serve to space a pair of curved walking members 24 from respective side surfaces of the wheel support plates 14. The walking members 24 are formed in an arched fashion and incorporate a high friction surface, such as the exemplary strip 26, along a lower ground-facing surface thereof. The strip 26 may be formed from rubber or another suitable material. The walking members 24 incorporate a pair of lower locking holes 28 and pair of upper locking holes 29 at respective ends of a plurality of slide slots 30 through which extends the corresponding plurality of bolts 16. A corresponding number of walking member control knobs 32 are disposed on respective ends of each of the plurality of bolts 16. A knob securing pin 34 is inserted into holes formed in a side surface of the walking member control knobs 32 and is received in the receptacles 20 disposed at respective ends of the bolts 16. The walking member control knobs 32 are provided with a finger grip ridge 38. A connecting rod 36 may be provided to connect each of the respective walking member control knobs 32 so that such knobs may be operated in a simultaneous fashion as described in more detail below.

The general operation of this invention will be described with reference to FIG. 2. The typical in-line skate boot 10 is provided with a braking pad 40 disposed substantially rearward of the heel of the boot 10 and is attached to the wheel support plates 14. As seen in the figure, the walking member 24 is shown illustrated in two positions: an up position 42 and a down position 44. In order to move the walking member 24 from the up position 42 to the down position 44, the bolts 16 which extend through the walking member 24 by passing through the slide slots 30 must be positionable in an upper bolt rest position 46 or a lower bolt rest position 48. A transitional slot 50 connects the upper bolt rest position 46 with the lower bolt rest position 48. Thus, referring to FIG. 2 specifically, in order for the walking member 24 to be moved from the up position 42 to the down position 44 (the walking member 24 is illustrated by dashed lines in the down position 44), the walking member 24 which is positioned such that the bolt 16, which is positioned at the lower bolt rest position 48, must be changed from the lower bolt rest position 48 via the transitional slot 50 and to the upper bolt rest position 46. Thus, when the bolts 16 are positioned in the upper bolt rest positions 46, the walking member 24 is disposed in the down position 44. Similarly, when the bolts 16 are positioned in the lower bolt rest positions 48, the walking member 24 is disposed in the up position 42. When the walking member 24 is disposed in the down position 44, the rubber strip 26 is preferably disposed at a position substantially level with the lowest position on the wheels 12. Of course the down position of the rubber strip 26 may be determined based on the distance between positions 46, 48.

Referring in more detail to FIG. 3, the transition of the walking member from the up position 42 to the down, position 44 as illustrated in more detail. Specifically, it is seen that the walking member control knobs 32 have a pair of locking pins 52 which protrude from an inner surface of the walking member control knobs 32. The locking pins 52 are preferably made of steel or suitably hard materials such as ceramic, in order to support the weight of the wearer. The locking pins 52 are received in the respective lower and upper locking holes 28, 29 seen in FIG. 1. By receiving the locking pins 52 in the respective locking holes 28, 29, the bolts 16 which attach to the walking member control knobs 32 are held in the respective upper and lower bolt rest positions 46, 48. A spring 54 is mounted inside of the bolt 16 and is used to bias the walking member control knobs 32 against the walking members 24. A spring channel 55 is provided within the bolts 16 to contain the spring 54. The spring 54 is preferably of sufficient strength to properly bias the walking member control knobs 32 while still allowing the wearer to be able to overcome the force of the spring 54 to move the walking member control knobs 32 in the direction of the directional arrows 56.

In operation; the control knob 32 is pulled by the wearer in the direction of the outward directional arrow 56 and the walking member 24 is moved by the wearer in the direction of the downward directional arrow 58. The transitional movement of the walking member 24 in the direction of the downward directional arrow 58 is achieved by the movement of walking members 24 relative to the bolts 16 in the transitional slots 50 between the lower bolt rest position 48 and the upper bolt rest position 46. It should be noted that the downward directional arrow 58 is additionally angled in an inward fashion. The arched movement of the walking member 24 as the position of the bolt 16 is changed from the lower bolt rest position 48 to the upper bolt rest position 46 is achieved due to the arcuate structure of the walking member 24. Specifically, the inward arc formation of the walking member 24 moves relative to spacer 22 which causes the ground-side surface 60 of the rubber strip 26 to move inward toward the wheels 12. As can be seen in FIG. 3, the rubber strip 26 is disposed along each side of the tip of the walking member 24. In this fashion, the rubber strip 26 includes a wheel-side surface 62. When the walking member 24 is disposed in the down position 44, as seen in FIG. 2, the wheel-side surface 62 of the rubber strip 26 is disposed substantially adjacent to the wheel 12. In this fashion, when the walking member 24 is in the down position 44, the wheels 12 are prevented from turning due to the frictional contact between the wheel-side surface 62 of the rubber strip 26 and the wheels 12. Of course, the rubber strip 26 may be provided with a tread or knobby bottom surface to assist in traction. The rubber strip 26 is also optional, or could be formed of a different material.

Referring back to FIG. 1, the walking member control knobs 32 may be pulled in an outward direction identified by the outward directional arrow 56, and turned to the prevent the locking pins 52 from remaining engaged in the respective locking holes 28, 29 due to the biasing force of the spring 54. After all of the knobs 32 have been pulled and turned to disengage the respective pins 52, walking member 24 may be slid between the up and down positions 42, 44, as seen in FIG. 2. Alternatively, a connecting rod 36 may be provided between each of the walking member control knobs 32. In this fashion, by pulling on the connecting rod 36, the wearer of the shoe may operate all of the walking member control knobs 32 located on a side of the in-line skate boot 10 simultaneously.

Figure 4:
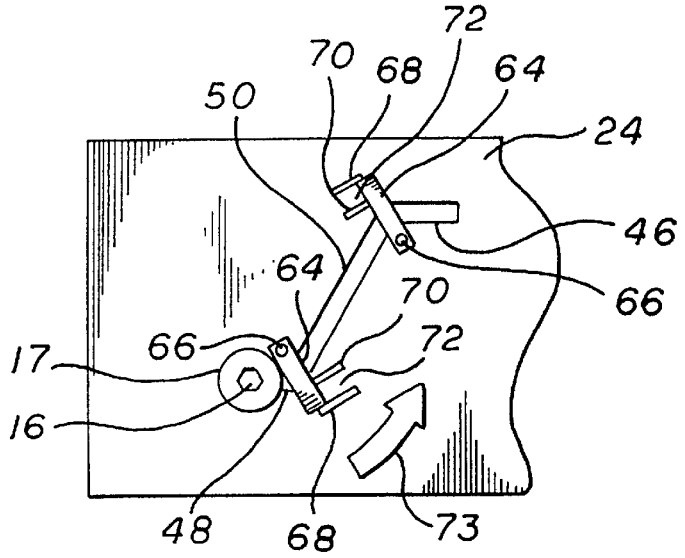
FIG. 4 is a partial side view of an alternative locking arrangement for use with the present invention.

Referring to FIG. 4, an alternative embodiment for a locking mechanism is shown. Specifically, in FIG. 4 the bolts 16 is provided with an optional rounded head 17. A locking arm 64 is disposed at the upper and lower bolt rest positions 46, 48. A pair of channels 68, 70 define a locking tongue 72 which is preferably formed to incline upwardly from the side of the walking member 24. The locking tongue 72 is formed integral with the walking member 24 and is moveable in a direction normal to the plane of FIG. 4. The locking arm 64 pivots in a circular fashion about a pivot pin 66.

In operation, the wearer simply pushes inward on the locking tongue 72 which allows the locking arm 64 to pivot about the pivot pin 66 in a circular fashion, thus releasing the bolt 16 and optional rounded head 17 from the upper or lower bolt rest positions 46, 48. Specifically, to move the walking member 24 such that the bolt 16 and optional rounded head 17 are changed from the lower bolt rest position 48 to the upper bolt rest position 46 seen in FIG. 4, the wearer would push down on the lower locking tongue 72, and pivot the locking arm 64 in the direction of directional arrow 73 about the pivot pin 66. This would allow the position of the bolt 16 and optional rounded head 17 to be changed to the transitional slot 50 and then up towards the upper bolt rest position 46. The upper locking arm 64 can remain in the position illustrated in FIG. 4 and when the bolt 16 and optional rounded head 17 reach the upper location, the upper locking arm 64 would pivot in a position opposite to the directional arrow 73 in circular fashion, thus, allowing the bolt 16 and optional rounded head 17 to enter the upper bolt rest position 46. The upper locking arm 64 would travel in a circular, clockwise fashion and slide over the upper locking tongue 72 (pushing the upper locking tongue in a downward fashion). When the upper locking arm 64 traveled past the upper locking tongue 72, the upper locking tongue 72 is biased so as to spring outward thus holding the upper locking arm 64 in the position illustrated in FIG. 4.

Figure 5:
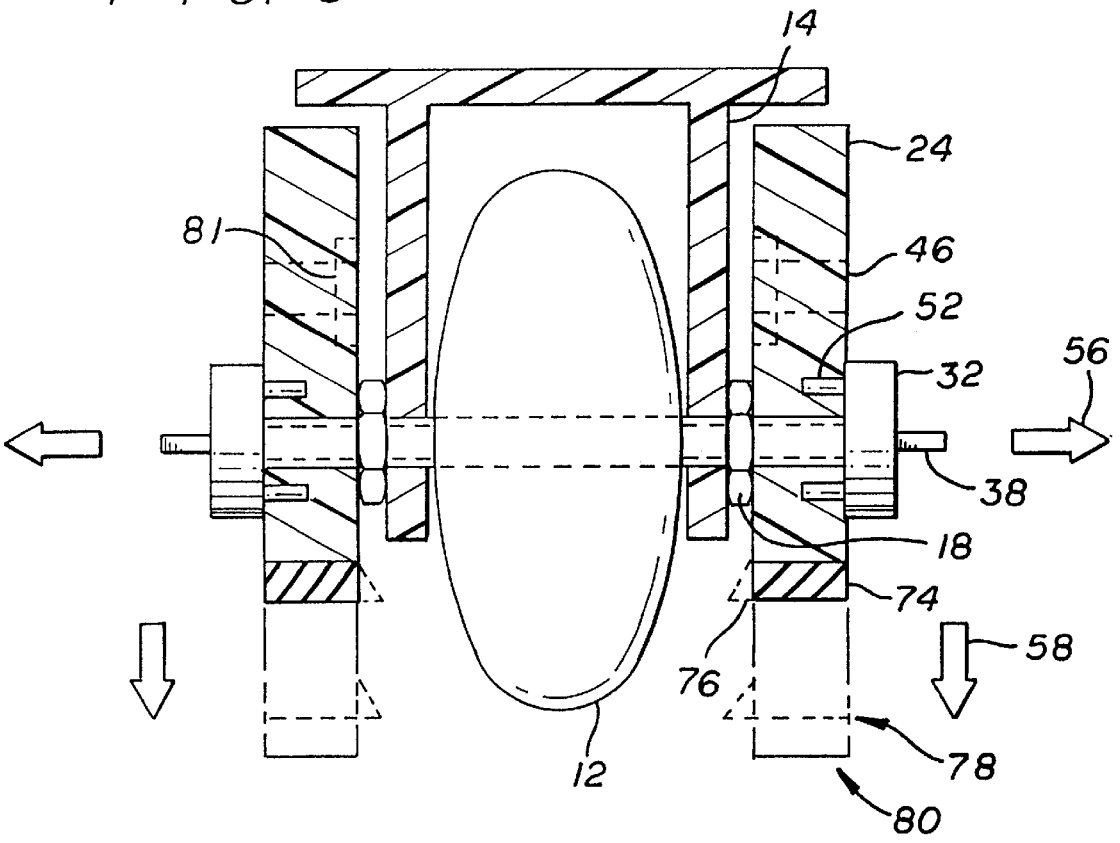
FIG. 5 is a partial cross-sectional view of another embodiment the present invention taken along lines 3—3 in FIG. 2.

FIG. 5 illustrates an alternative embodiment of the present invention in which the walking members are formed of straight vertical members as opposed to the arcuate members 24 illustrated in FIGS. 1–3. The embodiment illustrated in FIG. 5 works in a substantially similar fashion to that illustrated in FIGS. 1–3 with the exception of the ability to eliminate the spacer 22. In addition, the walking members 24 illustrated in FIG. 5 are provided with an alternative rubber strip 74 disposed along the ground-facing surfaces thereof. The rubber strip 74 may be provided with a flare 76 so as to provide an enhanced surface for the wearer to walk on. The rubber strip 74 may also be provided with a tread or textured surface to enhance traction. In addition, depending on the length of the transitional slots 50, the down position 44 of the walking members 24 illustrated in FIG. 5 can be either the position identified by reference numeral 78 which is substantially adjacent to the lower surface of the wheel 12 or a second position identified by the reference numeral 80 which is a position below the lower surface of the wheels 12.

In the position 80, the walking members 24 would support the entire weight of the wearer of the in-line skate boot 10, whereas in the position 78, it is possible that a portion of the weight of the wearer may be borne by the wheels 12, thus reducing the wear-and-tear on the walking members 24 and reducing the weight bearing strength required. It should be noted that in FIG. 3, the weight of the wearer is shared by the wheels 12 and the walking members 24, with the ends of the walking members 24 being formed so as to provide a large ground surface contact area for the walking members 24 and the wheels 12 to provide a stable walking surface for the wearer of the in-line skate illustrated in FIG. 1.

Additionally included in the embodiment shown in FIG. 5 are an optional pair of recesses 81 disposed on the inner wall surfaces of the walking members 24. The recesses 81 receive the respective nuts 18 therein when the walking members 24 are located in the down position 44. In this fashion, the walking members will be positioned in contact with the wheel support plates 14, thus adding to the structural rigidity of the present invention. The spring 54 is sufficiently strong to bias the walking members 24 against the wheel support plates 14. Further, in this position, it may be possible for the flared portion 76 of the rubber strip 74 to contact the wheels 12.

Figure 6:
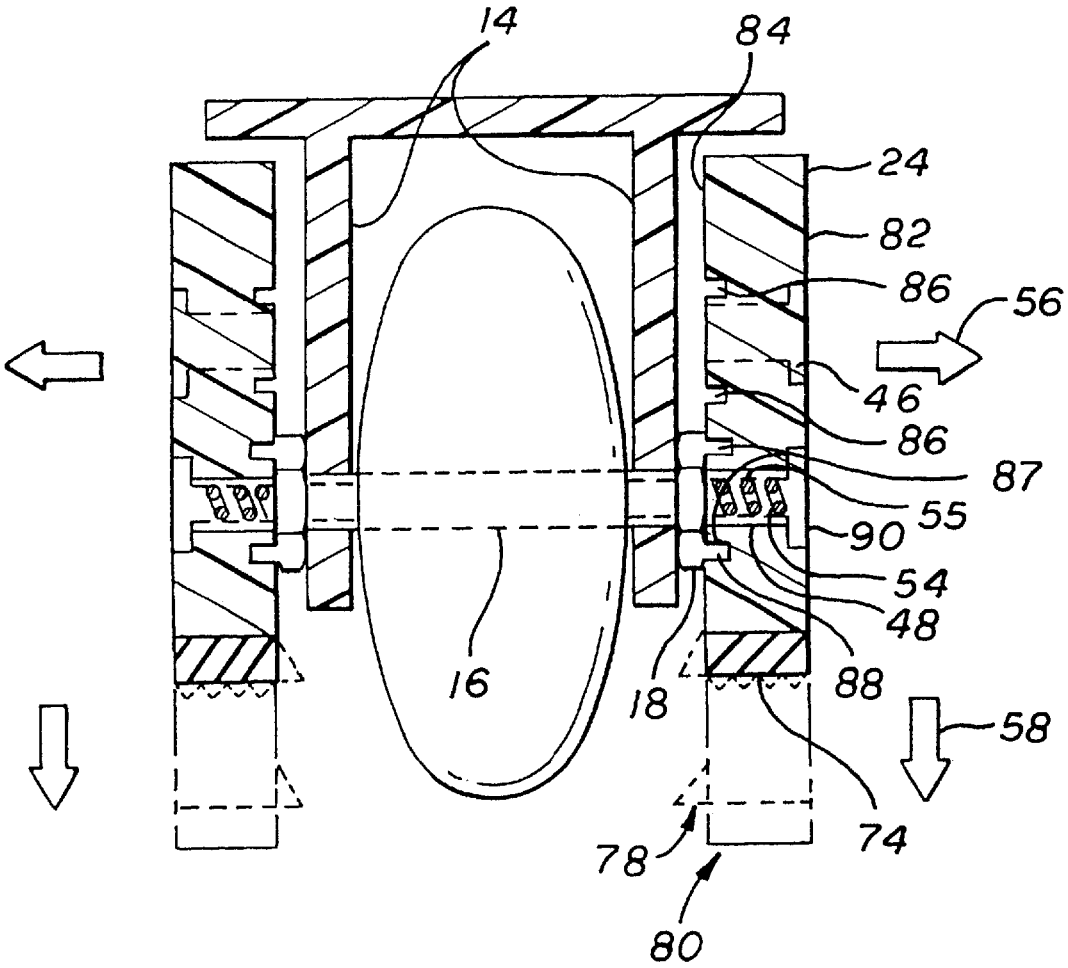
FIG. 6 is a cross-sectional view of still another embodiment of the present invention taken along lines 3—3 in FIG. 2.

FIG. 6 illustrates another embodiment of the present invention which eliminates the need for the walking member control knobs 32. Specifically, the walking members 24 illustrated in FIG. 6 have an outer wall surface 82 and an inner wall surface 84. The inner wall surface 84 of the walking members 24 are provided with a pair of upper locking pin receptacles 86 and a pair lower locking pin receptacles 87. The locking pin receptacles 86, 87 are provided to receive a corresponding pair of locking pins 88 which are disposed on the nuts 18 which is used to secure the bolts 16 to the wheel support plates 14. In this embodiment, a spring biased flat top 90 is provided for the bolt 16. A biasing force is provided by the spring 54 disposed in the spring channel 55 in fashion substantially similar to that seen in FIG. 3. In this embodiment, the flat top 90 of the bolt 16 allows the entire walking member 24 to be moved in the direction of the outward directional arrow 56. The walking member 24 is moved in the direction of the outward directional arrow 56 a sufficient distance to disengage the locking pins 88 from the locking pin receptacles 86 or 87. The walking member 24 is them moved so that the flat top 90 of the bolt 16 is slid along a channel formed in outer wall surface 82 of the walking member 24 from the lower bolt rest position 48 to the upper bolt rest position 46. Once the flat top 90 of the bolt 16 is positioned in the desired bolt rest position, 46 or 48, the wearer simply allows the biasing force of the spring 92 to pull the walking member 24 in a direction opposite to the outward directional arrow 56 thus causing the locking pins 88 to engage in the upper or lower locking pin receptacles 86, 87.

This embodiment eliminates the need for a connecting rod 36 between the walking member control knobs 32, thus eliminating the need for the wearer to operate a plurality of control knobs 32. This embodiment also contributes to the aerodynamic qualities of the in-line skates, incorporating the invention. The wearer simply has to grasp a walking member 24, pull the walking member 24 in the direction of the outward directional arrow 56 and slide the walking member 24 to the desired up or down position, 42, 44. As with the embodiment seen in FIG. 5, depending upon the length of the transitional slot 50, the walking member 24 may be positioned in either of two down positions 78, 80.

As illustrated for example in FIGS. 7–16, walking members may also be provided that simply prevent one or more of the wheels 12 from turning. Referring first to the exemplary embodiment of the invention illustrated in FIGS. 7 and 8, a walking member 94 which moves inwardly into engagement with the wheels 12 and outwardly away from the wheels may be used in conjunction with an in-line skate boot 10' having a brake system 11. The walking member 94 includes a wheel engagement member 96 and a support device 98 that may be mounted on the bolts 16 (as shown) or on some other structure added to the support member. The wheel engagement member 96 preferably includes high friction surface, such as the exemplary strip 100, which may be formed from rubber or another suitable material. The support device 98 includes a series of holes (not shown) through which the bolts 16 pass to mount the support device on the support members 14.

Figure 8:
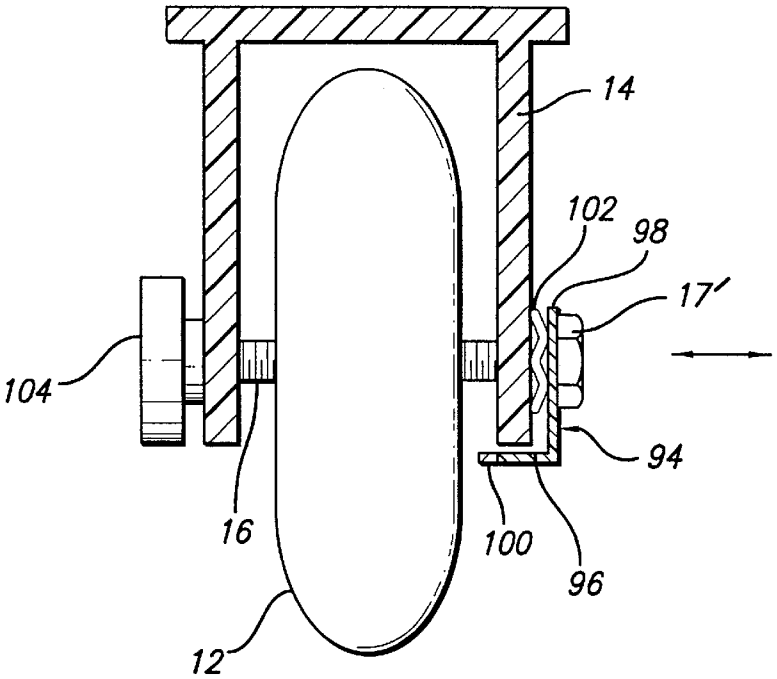
FIG. 8 is a section view taken along lines 8—8 in FIG. 7.
Figure 7:
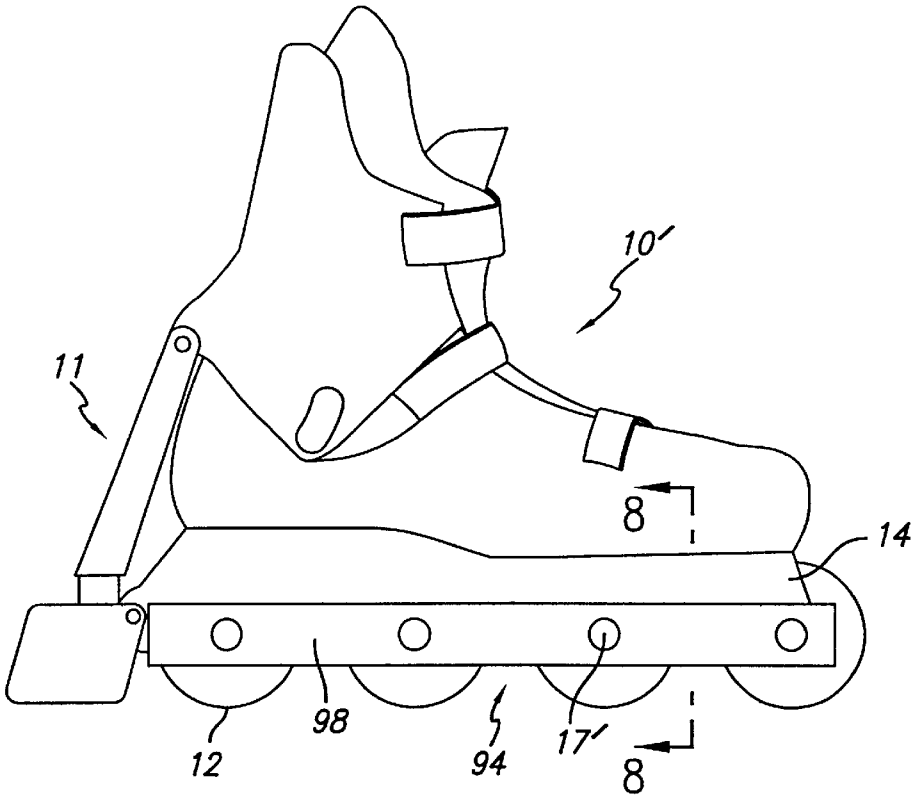
FIG. 7 is a side elevation view of an in-line skate incorporating another embodiment of the present invention.

In the exemplary embodiment illustrated FIGS. 7 and 8, the support device 98 is biased away from the support member 14 and wheels 12 by a biasing element 102 such as a wavy metal spring (as shown), helical spring or elastic member. The biasing force may be overcome, and the walking member 94 urged against the wheels 12, through rotation of a threaded knob 104 that is mounted on one of the middle two bolts 16. Nuts are mounted on the ends of the other bolts 16. Rotation of the knob 104 in one direction will cause the bolt 16 (and bolt head 17') to move towards the knob, while rotation in the other direction cause the bolt to move away from the knob and allow the biasing element to urge the walking member 94 away from the wheels 12. Of course, additional knobs may be mounted on some or all of the remaining bolts instead of the nuts, if so desired.

The walking member 94 may be driven into engagement with the wheels 12 by a variety of devices other than the exemplary knob 104. As illustrated for example in FIGS. 9 and 10, a sliding member 106, including a main body 108 and a ramp 110, may be mounted on one of the bolts 16 and secured in place with an end cap 112. The sliding member 106 also includes an elongate slot 114, which allows the sliding member to move upwardly and downwardly relative to the support members 14, and a pair of handle tabs 116 and 118. Downward movement of the sliding member 106 from the position shown causes the ramp 110 to engage the cap 112 and pull the bolt 16 toward the sliding member. As a result, the biasing force provided by the biasing element 102 is overcome and the walking member 94 is urged against the wheels 12. The sliding member 106 may be relatively narrow (measured along the longitudinal axis of the skate) and mounted on a single bolt 16 (as shown). Alternatively, the sliding member 106 may be relatively long and have a plurality of slots 114 so it can be mounted on more than one or on all of the bolts 16.

Figure 11:
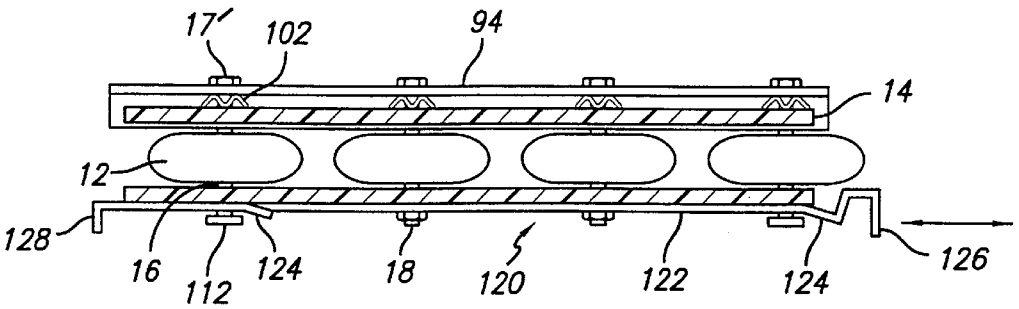
FIG. 11 is a top view of another embodiment of the present invention.
Figure 9:
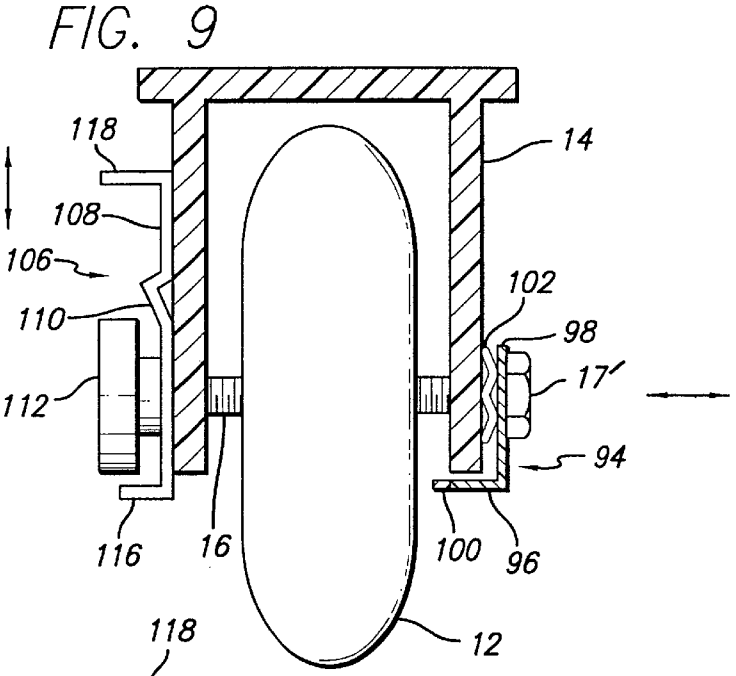
FIG. 9 is a section view taken along lines 8—8 in FIG. 7 of still another embodiment of the present invention.
Figure 10:
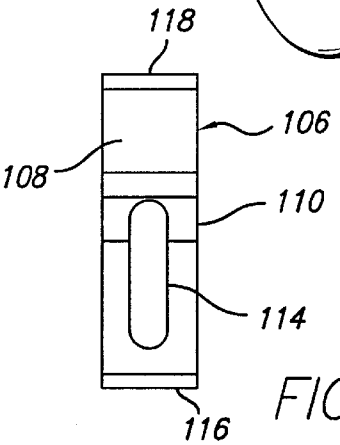
FIG. 10 is an elevation view of a portion of the embodiment illustrated in FIG. 9.

Turning to FIG. 11, a similar sliding member 120 may be mounted for horizontal movement on the bolts 16. The exemplary sliding member 120, which includes a main body 122 and two or more ramps 124, is held in place by end caps 112 and nuts 18. The ramps 124 engage the end caps 112 as the sliding member 120 moves rearwardly to drive the walking member 94 against the wheels 12. A pair of handle tabs 126 and 128 are also provided.

Figure 12:
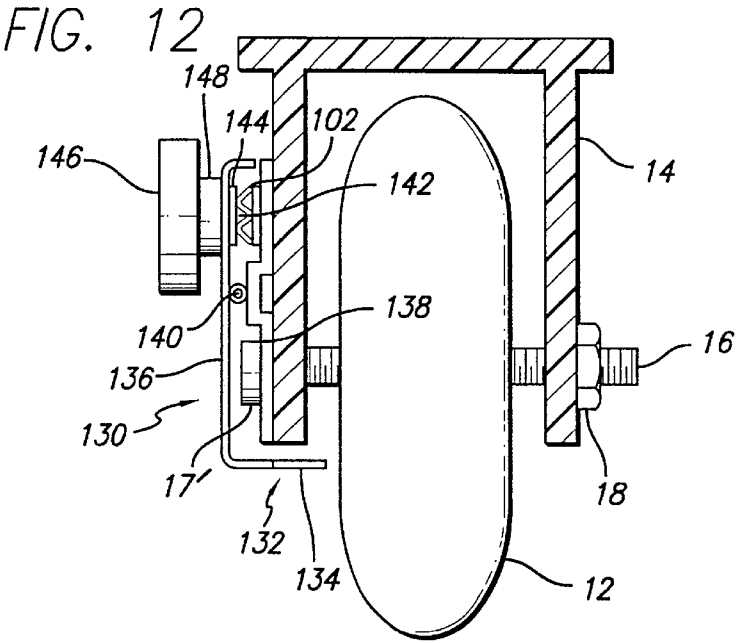
FIG. 12 is a section view taken along lines 8—8 in FIG. 7 of yet another embodiment of the present invention.

Another preferred embodiment of the invention is illustrated in FIG. 12. The exemplary walking member 130, which moves inwardly into engagement with the wheels 12 and outwardly away from the wheels, includes a wheel engagement member 132 with a high friction surface, such as the exemplary strip 134 formed from rubber or another suitable material, and a support device 136. The support device 136 is pivotably mounted on a base 138 with a hinge 140. A threaded bolt 142, which is mounted on the support member 14, passes through the support device 136 and a reinforcing element 144 that is mounted on the support device. A wavy metal spring 102 or other biasing element located between the reinforcing element 144 and the base 138. Spring 102 biases the associated portion of the support device 136 away from the support member 14 such that the engagement member 132, which is on the opposite side of the hinge 140, is biased against one or more of the wheels 12. A rotatable knob 146 having a base 148 is positioned on the end of the bolt 142 against the support device 136. The knob 146 may be rotated to drive the portion of the support device 136 associated therewith towards the support member 14 and drive the engagement member 132 away from the wheels 12.

The exemplary embodiment illustrated in FIG. 12 may be reconfigured in a variety of ways. For example, the spring 102 (which is in compression) may be replaced by a tension spring located between the support device 136 and the knob base 148.

Figure 15:
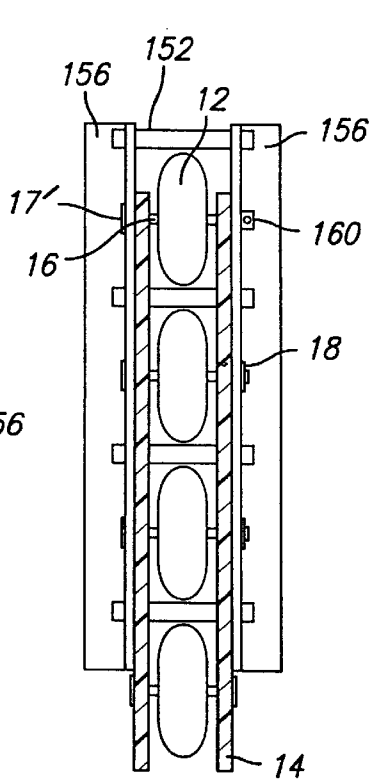
FIG. 15 is a top view of the embodiment illustrated in FIG. 13.
Figure 14:
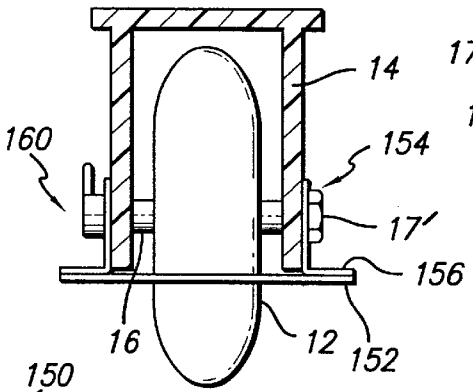
FIG. 14 is a section view taken along lines 14—14 in FIG. 13.
Figure 13:
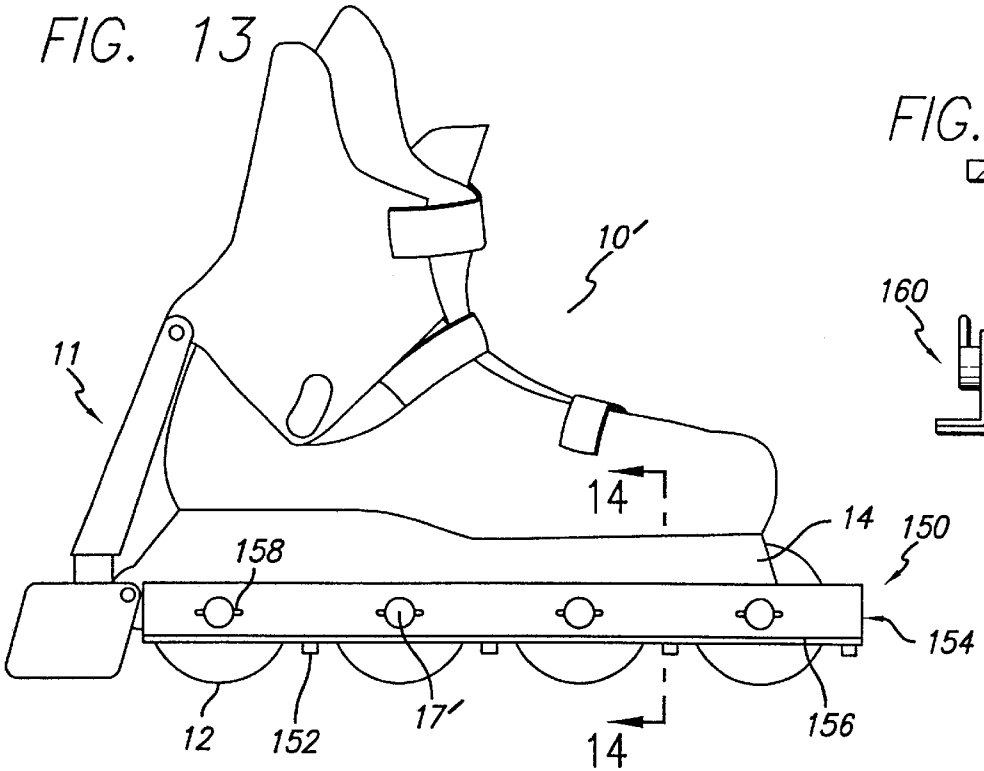
FIG. 13 is a side elevation view of an in-line skate incorporating another embodiment of the present invention.

As illustrated for example in FIGS. 13–15, a walking member 150 in accordance with another embodiment of the invention moves longitudinally into and out of engagement with the wheels 12. The exemplary walking member 150 includes a plurality of engagement members 152 and a support device 154 that supports the engagement members. In the illustrated embodiment, the support device includes a pair of brackets 156 that are supported on the bolts 16.

Elongate slots 158 allow the brackets 156 to be moved longitudinally. A cam actuated locking device 160, or other suitable locking device, may be used to maintain the walking member 150 in a position where it engages the wheels 12 or in a position where it is out of engagement with the wheels.

Figure 16:
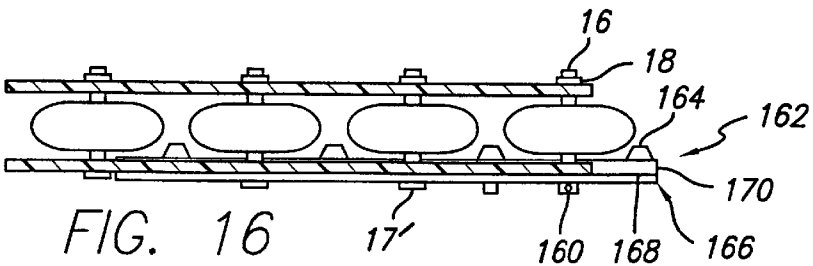
FIG. 16 is a top view of another preferred embodiment of the present invention.

Another exemplary longitudinally movable walking member, which is generally represented by reference numeral 162, is illustrated in FIG. 16. Exemplary walking member 162 includes a plurality of wheel engagement members 164 and a support device 166. The support device 166 is generally L-shaped and includes a first portion 168 with plurality of elongate slots (similar to slots 158 in FIG. 13) through which the bolts 16 extend and a second portion 170 on which the wheel engagement members 164 are supported. The longitudinal position of the walking member 162 may be fixed with a cam actuated locking device 160 or other suitable locking device.

Figure 17:
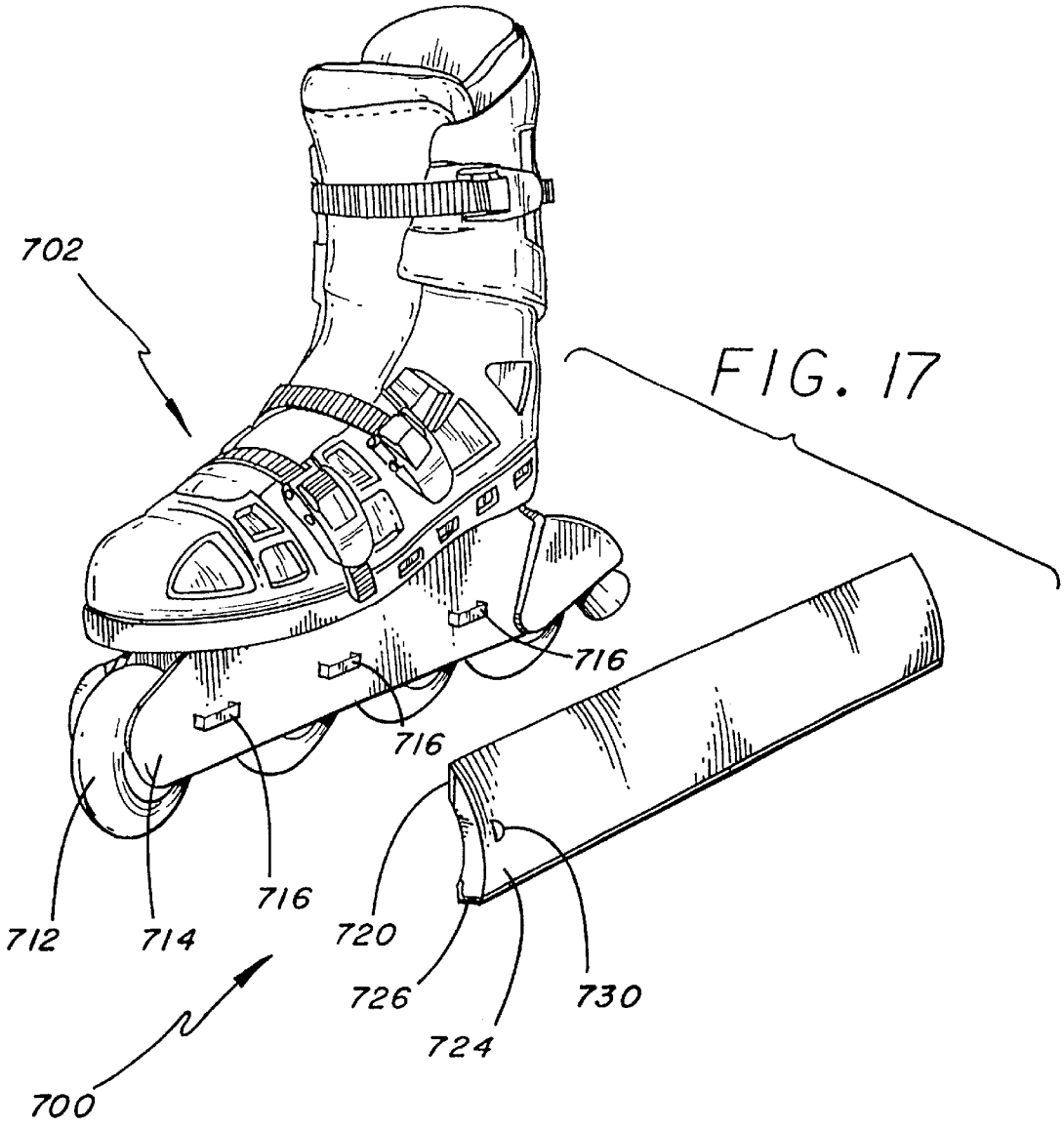
FIG. 17 is an exploded perspective view of an in-line skate incorporating another embodiment of the present invention.
Figure 19:
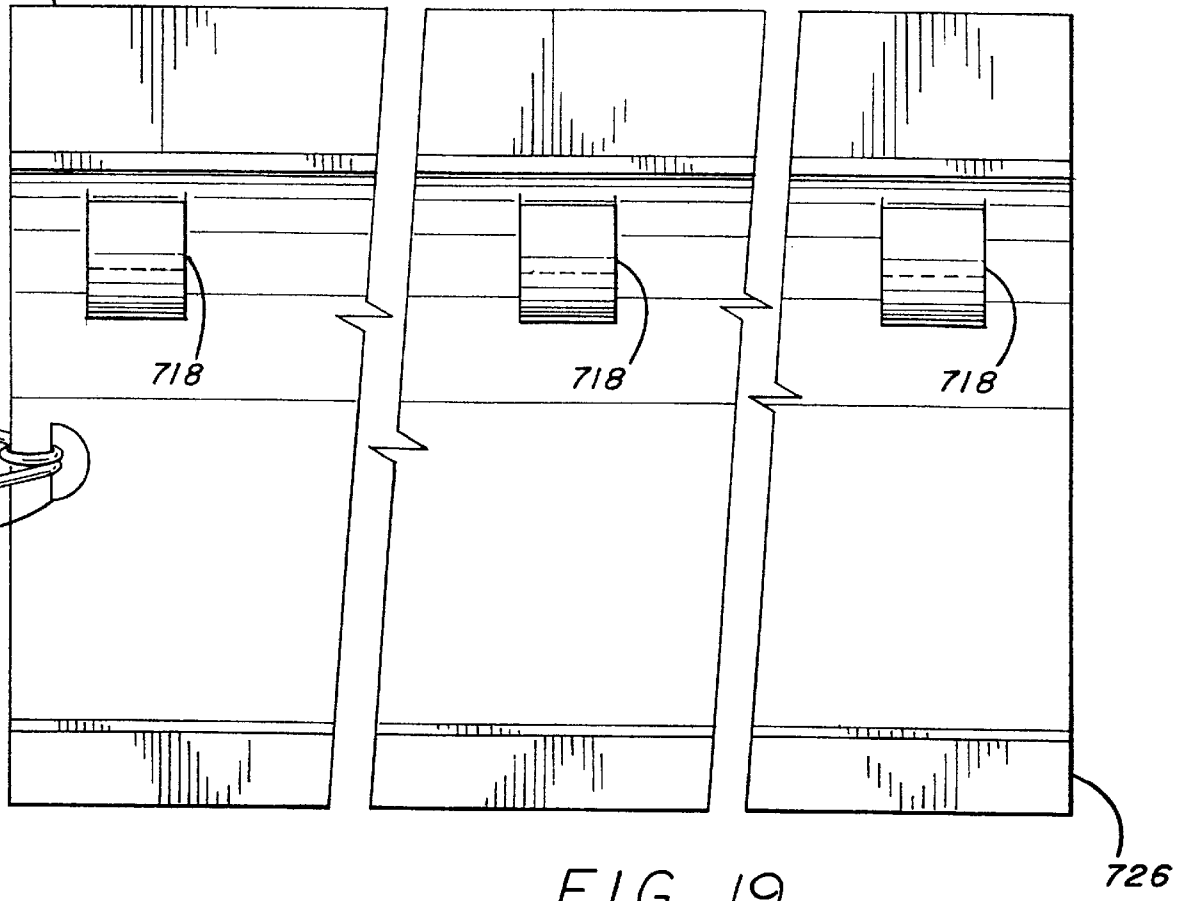
FIG. 19 is a side view of the detachable walking member illustrated in FIG. 17.

In a further embodiment of the present invention which incorporates many of the above features and advantages, the inventor has recognized that in certain situations the wearer of in-line skates may not desire to have walking members attached to the in-line skate at all times (whether in use or not). As such, the embodiment of the present invention illustrated in FIG. 17 provides an alternative to the embodiments of FIGS. 1–6, while still maintaining the attendant advantages thereof.

Referring to FIGS. 17–20, a detachable in-line skate conversion apparatus 700 is illustrated. The detachable in-line skate conversion apparatus includes an in-line skate 702 having a plurality of wheels 712 and a wheel support member or plate 714 between which the wheels 712 are positioned as in the embodiment of the present invention described above. In the present embodiment, the support plate 714 is fitted with a series of loops or support members 716. The support members 716 may be U-shaped (as shown) or another suitable shape. A plurality of walking members 724 are provided in a manner similar to the embodiment described above. In this embodiment, the walking members are provided with a series of hooks or tongues 718 disposed on the back surface thereof which detachably engage the support members 716. Thus, the walking members may be attached to and removed from the in-line skate as needed. Other suitable coupling devices may, of course, be substituted for the exemplary loop and hook arrangement.

The walking members 724 are provided with a resilient member 720 along an upper surface thereof. The resilient member 720 provides a positive bias force away from the surface of the support plate 714, but the bias force may be overcome by application of sufficient force by the wearer. As such, the arrows 733 seen in FIG. 20 illustrate the motion capable by the walking member 724 relative to the support plate 714.

As in the embodiments described above, the walking members 724 are provided with a grip strip 726 to provide proper friction with the ground and against the wheels 712. While the grip strip 726 is preferably made of rubber, it may be made of any suitable material. In addition, a hole 730 is provided at one end of the walking members 724 to provide a suitable location to provide an attachment member to attach the walking members 724 to each other, as seen, for example, in FIG. 20. Any suitable cord 732 could be utilized for this purpose, including rubber, nylon, or any natural or synthetic material. The cord 732 may be sized to provide a further bias force across the front of the wheels 712 in a direction toward the viewer of FIG. 20.

Figure 18:
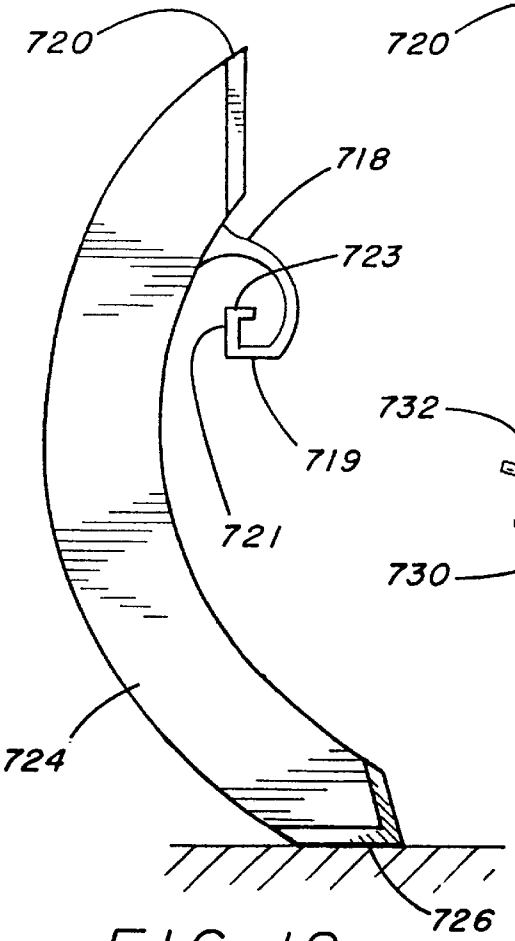
FIG. 18 is a front view of the detachable walking member illustrated in FIG. 17.
Figure 20:
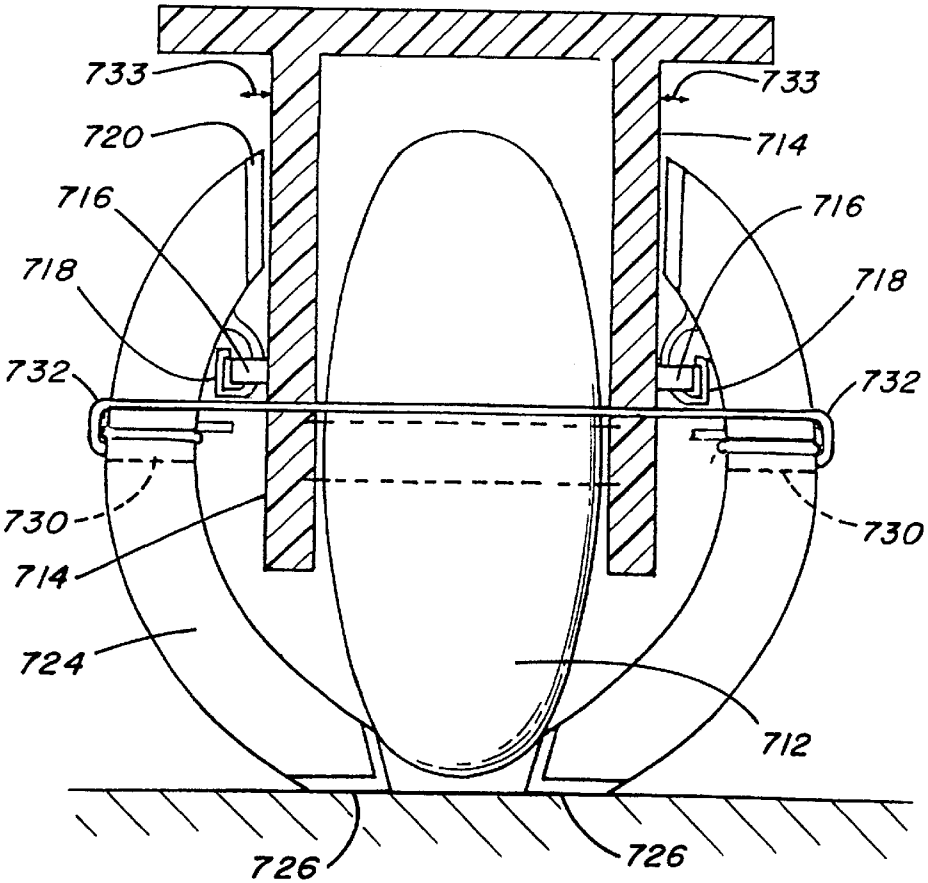
FIG. 20 is a front view of the exemplary embodiment illustrated in FIG. 17.

Referring more particularly to FIGS. 18 and 20, the hooks or tongues 718 may be formed integral with the walking member 724 and include a flat portion 719, a vertical portion 721 and a second flat portion 723. The hook or tongues 718 may be made of any suitable material, for example, metal, plastic, ceramic or other material. The hooks may be formed integral with the walking member through an injection molding process or may be fastened to the walking member 724 by heat, adhesive, screws, bolts, rivets or any other suitable fastening method.

By providing the resilient member 720, it is possible to place the walking member up against the support member 714, then press to overcome the bias force provided by the resilient member 720, and thus insert the hook/tongue 718 through the loops 716. After insertion, the bias force ensures that the hook and loop 718 and 716 will remain engaged as the wearer walks. The second flat portion 723 is provided to engage the loop 716 and support the wearer as the wearer walks. In addition, the bias force produced by the resilient portion 720 produces a torque about the hook 718-loop 716 connections that pushes the grip strip 726 down towards the wheels 712 when the wearer picks up their foot. In addition to assisting in preventing the hook and loop connections from becoming disengaged, this also assists in preventing inadvertent spinning of the wheels 712.

Figure 21:
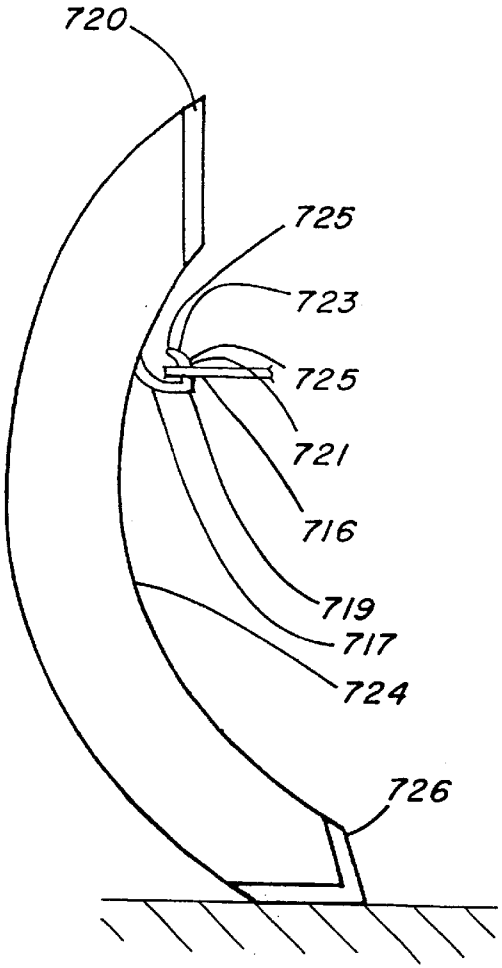
FIG. 21 is a front view of the detachable walking member illustrated in FIG. 18 using an alternative connection mechanism.
Figure 22:
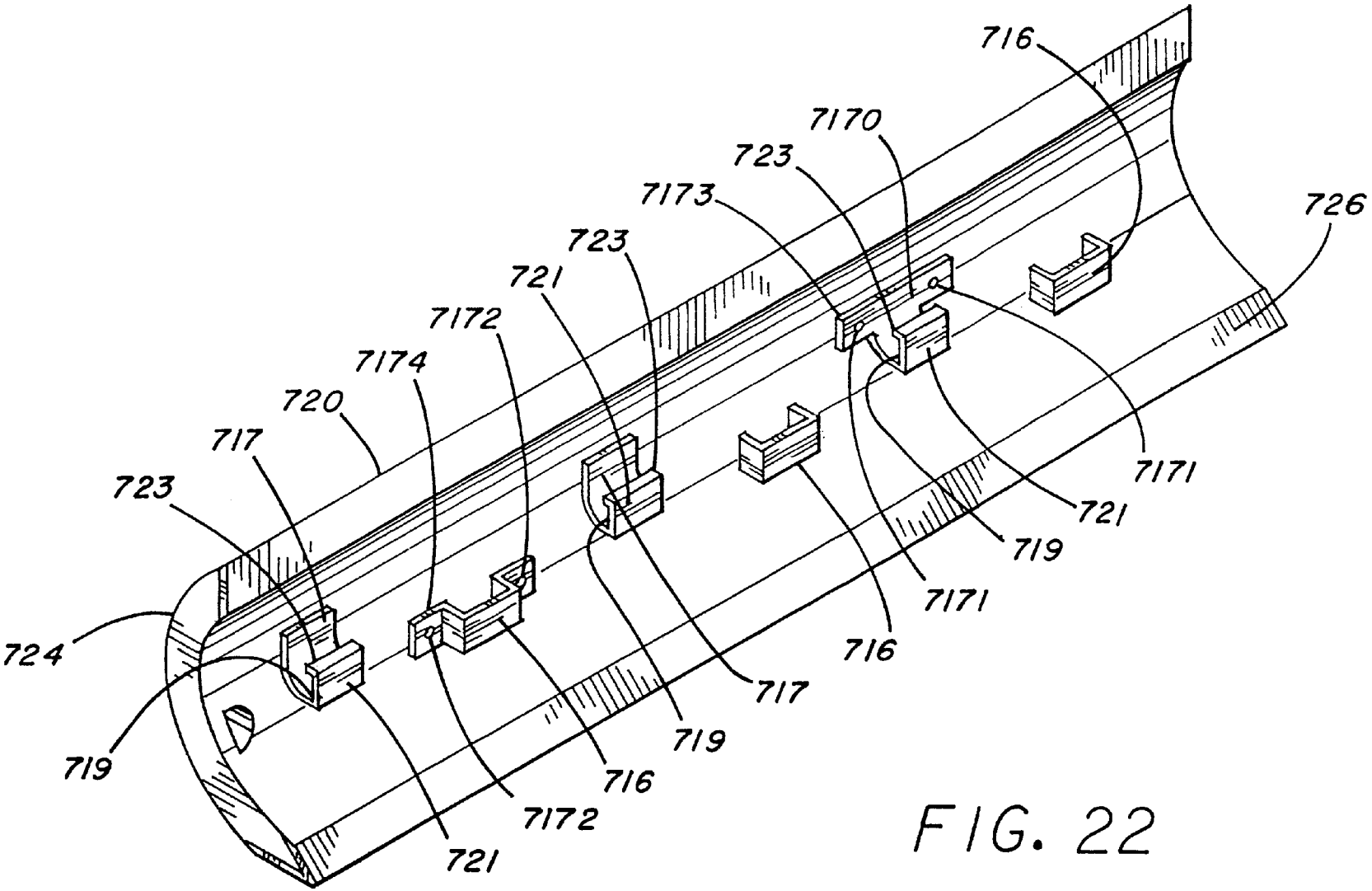
FIG. 22 is a perspective view of a walking member in accordance with still another embodiment of the present invention.

In an alternative embodiment, as seen in FIGS. 21 and 22, the hook/tongue 717 is shaped so that the upper portion of the hook 717 is open. In this embodiment, the loops 716 will readily engage the upper flat portion 723 of the hook/tongue 717. As such, with the bias force of the resilient member 720 providing a proper bias of the loop 716 against the vertical portion 721 of the hook 717, the weight of the wearer will be properly supported.

In addition, the edges 725 of the hook 717, between the vertical portion 721 and the upper flat surface 723, are rounded to assist the wearer in installing and removing the walking members 724. The rounding of the hook member 717 may also be utilized in the previous embodiments and the invention is in no way limited to the shape of the hook illustrated in the drawings.

Figure 23:
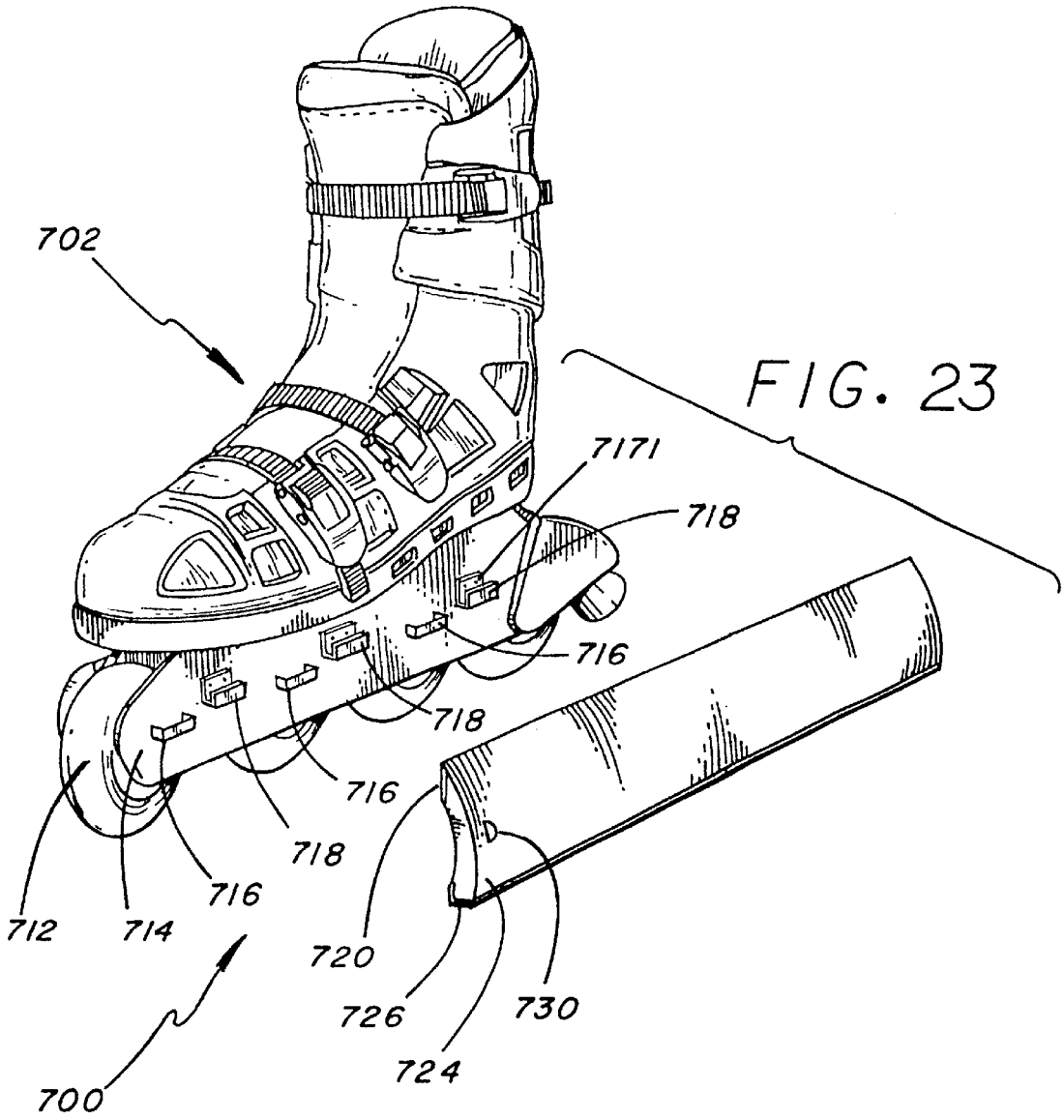
FIG. 23 is a perspective view of an in-line skate including a conversion apparatus in accordance with the exemplary embodiment illustrated in FIG. 23.

As seen in FIGS. 22 and 23, an alternative method for fastening the hooks or tongues 717 to the walking member 724 is illustrated. The hook or tongue 7170 is attached to the walking member 724 using fastening members 7171 that may be screws, rivets, bolts or any other suitable fastener. Alternatively, adhesive could be used in place of the fasteners or the flanged portions 7173 may be embedded in the material of the walking member 724. The other structure of the hook or tongue 7170 is the same as that seen in FIG. 21, including the flat portion 719, vertical portion 721 and second flat portion 723. The same fastening techniques can be used with the hook or tongues 718. As also seen in FIG. 22, the loops 716 may be provided with wings 7174 through which a rivet, screw or other fastening device 7172 is provided to secure the loop 716 to the walking member 724. As with the hook or tongue 7170, the wings 7174 may also be fastened to the walking member 724 using adhesive or may be embedded in the walking member 724.

As also illustrated in FIGS. 22 and 23, those skilled in the art will readily appreciate that this embodiment may be altered such that the hooks/tongues 718 are provided on the support member 714 (FIG. 23) while the loops 716 may be provided on the walking members 724 (FIG. 22). The combinations of hooks and loops may also be mixed as FIG. 22 illustrates to include both hooks and loops on the walking member 724 and the support member 714. In addition, any suitably shaped hook/loop members may be utilized, and the present invention is in no way limited to the illustrated hook and loop structure. In addition, as those skilled in the manufacturing arts will readily appreciate, the hook/loop connection mechanism may be provided on the in-line skates during the manufacture of the skate or may be added by the owner of the skate after the purchase of the skate.

In addition, while FIGS. 22 and 23 illustrate the use of both hooks and/or loops on the walking member 724, the invention is not limited to the use of hooks or loops. Any suitable number and combination of hooks and/or loops may be combined on both the walking member and in-line skate to assist in removably fastening the walking member to the in-line, skate. In addition, as with the embodiments of FIGS. 1–6, the walking members 724 are not limited to the arcuate shape shown in the drawings but may also be flat, or any other suitable shape.

While the above-described features of the illustrated embodiments are representative of preferred embodiments of the invention, it should be understood that the present invention is in no way limited to device with such features. Numerous modifications, additions and substitutions can be made to the above-described preferred embodiments of the invention without departing from the spirit and scope of the invention.

For example, numerous locking devices can be substituted for the devices illustrated in the FIGS. 1–6 to hold the bolt 16 in the upper or lower position. Similarly, while the illustrated embodiments includes nuts and spacers in association with the bolts which hold the wheels in place on the skate, one skilled in the art would readily recognize that an integral bolting assembly could be formed which serves several functions, thus eliminating a need for separate parts. Also, while the preferred embodiment utilizes injection molded plastic for the walking members described above, one skilled in the art would readily recognize that light weight aluminum, ceramic, polyvinylchloride (PVC), and other suitable materials could be substituted for the plastic of the present invention.

Similarly, while the preferred embodiments illustrated in FIGS. 1–6 and 17–23 include a pair of curved and straight walking members, one skilled in the art would readily recognize that it would be possible to incorporate different shapes for the walking members, or different combinations. For example, one curved and one straight walking member could be utilized, thus providing a stable walking platform while securing the wheels through the agency of the rubber strip disposed along the ground-facing edge of the curved walking member.

Turning to FIG. 4, a spring biasing force on the head of the bolt 16 is not necessarily required in order for the embodiments illustrated in FIGS. 1–6 to operate. It is also possible to utilize slots 30 having any desired shape including vertical. The embodiments illustrated in FIGS. 1–6 are not limited to the shape of the slots 30 shown in the drawings. Through the illustrated embodiments, an in-line skate may be provided with walking members to allow the wearer thereof to walk in a substantially normal fashion while wearing the in-line skates, without fear of falling due to the rolling of the wheels. In addition to being manufactured for use with original equipment manufacture in-line skates, the present invention can easily be provided as an add-on device for existing in-line skates by replacing the current bolts holding the wheels to the wheel support plates and replacing them with the bolts sufficient to support the walking members illustrated in the figures above discussed.

Lastly, while the bolts 16 in the figures appear to be of substantial length, one skilled in the art will readily recognize that the bolts 16 need only be of sufficient length to support the walking members thereon.

The discussion above illustrates that numerous modifications, additions and substitutions can be made to the present invention without departing from the spirit and scope thereof. The invention is best defined by the claims which appear below.

We claim:

1. An in-line skate conversion apparatus for use with an in-line skate defining a longitudinal axis and having a plurality of wheels and a plurality of wheel supporting axles, the apparatus comprising:

a wheel engagement member; and a support device associated with the wheel engagement member and configured to be operably connected to the wheel supporting axles and to slide along the wheel supporting axles such that the wheel engagement member is longitudinally movable between a first position wherein the wheel engagement member engages at least one of the wheels and a second position wherein the wheel engagement member is disengaged from the at least one wheel.

2. An apparatus as claimed in claim 1, wherein the wheel engagement member defines a first wheel engagement member, the apparatus further comprising:

a second wheel engagement member.

3. An apparatus as claimed in claim 1, wherein the wheel engagement member comprises first and second wheel engagement members and the support device comprises first and second support devices respectively supporting the first and second wheel engagement members on the in-line skate.

4. An apparatus as claimed in claim 1, wherein the wheel engagement member comprises a high friction surface.

5. An apparatus as claimed in claim 1, wherein the wheel engagement member comprises a longitudinally extending member.

6. An apparatus as claimed in claim. 1, wherein the support device Includes at least one slot adapted to ride on at least one of the wheel supporting axles.

7. An apparatus as claimed in claim 6, wherein the at least one slot is substantially s-shaped.

8. An apparatus as claimed in claim 6, wherein the at least one slot defines longitudinal ends and is substantially linear from one longitudinal end to the other.

9. An apparatus as claimed in claim 1, wherein the support device includes a plurality of slots adapted to ride on respective wheel supporting axles.

10. An apparatus as claimed in claim 1, wherein the support device comprises an arcuately shaped walking member.

11. An apparatus as claimed in claim 1, further comprising:

a lock apparatus adapted to be mounted on at least one of the wheel supporting axles and to fix the wheel engagement member in at least the first position.

12. An apparatus as claimed in claim 1, wherein the support device supports the wheel engagement member between adjacent wheels.

13. An apparatus as claimed in claim 12, wherein the wheel engagement member comprises a bar.

14. An apparatus as claimed in claim 12, wherein the wheel engagement member comprises a relatively short member.

15. An in-line skate conversion apparatus for use with an in-line skate defining a longitudinal axis and having a plurality of wheels and a plurality of wheel supporting axles, the apparatus comprising:

a plurality of wheel engagement members; and a support device associated with the wheel engagement members and configured to be operably connected to the wheel supporting axles and to slide along the wheel supporting axles such that the wheel engagements members are longitudinally movable between respective first positions where the wheel engagement members engage the wheels and respective second positions where the wheel engagement members are disengaged from the wheels.

16. An apparatus as claimed in claim 15, wherein the support device comprises an elongate member having a plurality of longitudinally extending slots configured to be respectively received by the plurality of wheel supporting axles.

17. An apparatus as claimed in claim 16, wherein the elongate member includes a first portion in which the slots are formed and a second portion, extending substantially perpendicularly from the first portion, that supports the wheel engagement members.

18. An apparatus as claimed in claim 17, wherein the elongate member is substantially L-shaped.

19. An apparatus as claimed in claim 16, wherein the wheels define a wheel diameter and each wheel engagement member is spaced apart from an adjacent wheel engagement member by a distance greater than the wheel diameter.

20. An apparatus as claimed in claim 15, further comprising:

a lock apparatus adapted to be mounted on at least one of the wheel supporting axles and to fix the wheel engagement members in at least the first positions.

21. An apparatus as claimed in claim 15, wherein the support device supports the wheel engagement members between adjacent wheels.

22. An apparatus as claimed in claim 15, wherein the wheel engagement members comprise relatively short members.

* * * * *